United States Patent [19]

Hannon

[11] 4,148,724

[45] Apr. 10, 1979

[54] WEDGE-TYPE TENSIONING RAIL CONSTRUCTION FOR ELECTRICALLY HEATED SCREENS

[75] Inventor: Thomas W. Hannon, Louisville, Ohio

[73] Assignee: Hannon Electric Company, Canton, Ohio

[21] Appl. No.: 860,244

[22] Filed: Dec. 13, 1977

[51] Int. Cl.[2] ..... B07B 1/49

[52] U.S. Cl. ..... 209/403; 209/238

[58] Field of Search ..... 209/403-404, 209/238; 210/DIG. 3; 55/DIG. 31, 501, 511; 101/415.1, 127.1, 128, 128.1; 160/378, 383, 399, 402, 403

[56] References Cited

U.S. PATENT DOCUMENTS

| | | | |
|---|---|---|---|
| 1,353,549 | 9/1920 | Sturteuant | 209/347 |
| 1,663,164 | 3/1928 | Helman | 209/403 |
| 1,932,920 | 10/1933 | Berghoefer | 209/403 |
| 2,213,773 | 9/1940 | Stmons | 209/403 |
| 2,381,029 | 8/1945 | Beil | 209/403 |
| 2,812,062 | 11/1957 | Hannon | 209/238 |
| 3,369,662 | 2/1968 | Rohner | 209/403 |
| 3,483,912 | 12/1969 | Andrews | 160/327 |
| 3,666,277 | 5/1972 | Hubach | 209/403 |
| 3,776,382 | 12/1973 | Wright | 209/403 |

*Primary Examiner*—Robert Halper
*Assistant Examiner*—Jon E. Hokanson
*Attorney, Agent, or Firm*—Frease & Bishop

[57] ABSTRACT

A rail construction for mounting and tensioning an electrically heated screen on and between a pair of longitudinally extending, spaced frame members. The rail preferably is formed as an aluminum extrusion having a relatively large metal mass in cross section. The rail has a modified channel shape in cross section with an upper curved flange, a lower angled flange and an intervening projection. The upper curved flange is enclosed with electrical insulation and is adapted to engage a vertical wall of one of the frame members when mounted thereon. The lower angled flange has a hook shape complementary to a hook shape formed on the edge of the screen cloth. The intervening projection forms a wedge-shaped channel in combination with the lower hook-shaped flange of the rail. The wedge-shaped channel has an angled surface against which a complementary wedge-shaped clamping bar clamps the hooked screen edge. A series of bolts extending through the rail from the outside surface clamp the wedge bar, and interposed hooked screen edge, against the angled surface of the wedge-shaped channel. A plurality of bolts extend through the rail and are engageable wih a vertical wall of the frame member and are adapted to draw the rail toward the wall to tension the screen which is clamped to the rail by the wedge bar. Electrical insulators are mounted on the rail bolts, and are located between the frame member and bottom of the rail to electrically insulate the rail from its associated frame member. One or both surfaces of the opposed clamping surfaces of the wedge bar and wedge-shape channel may be serrated to provide increased gripping contact between the wedge clamp and the screen edge.

17 Claims, 8 Drawing Figures

WEDGE-TYPE TENSIONING RAIL CONSTRUCTION FOR ELECTRICALLY HEATED SCREENS

BACKGROUND OF THE INVENTION

1. Field of the Invention

The invention relates to electrically heated screens, and particularly to rail members which extend longitudinally along the edges of the screen for mounting and tensioning the screen on a pair of spaced side frame members. More particularly, the invention relates to a tensioning rail having a wedge-shaped clamping bar which securely clamps the screen edge to the rail and which provides an improved electrical connection between the rail and screen.

2. Description of the Prior Art

Screen assemblies have been used in industry for many years for screening of materials. The screens may be oscillated mechanically to assist in screening the material, or may be stationary. In either case the screen is heated electrically to reduce binding and clogging of the screen openings. Examples of such electrically heated screen constructions and the means for electrically heating the same are shown in my previously issued U.S. Pat. Nos. 2,704,155, 2,812,062, 2,825,461, 3,154,757, and 3,195,725.

Screen constructions of the type shown in my above-identified patents and in other screen assemblies have rails which extend longitudinally along the edges of the screen or screen panels for mounting and tensioning the screen cloth or fabric on a pair of associated side frame members. These tensioning rails generally are formed of metal having good electrical conducting characteristics and are connected to a source of electrical power which is transferred through the rails to the metal screen material for heating the same. The rails, in turn, are mounted on the side frame members and are electrically insulated therefrom by various insulating means.

The screen edges are connected by various means to the tensioning rails in order to provide an electrical connection between the rail and screen and to provide means for tensioning the screen between the spaced side frame members. Various types of connections have been devised for both electrically heated screen constructions and for mechanically oscillated screen constructions.

One type of screen connection consists of a pair of mutually engaged, reversely angled brackets, such as shown in U.S. Pat. Nos. 1,353,549 and 2,052,467. Another type of connection consists of forming a reversely angled, stiffened and reinforced edge on the screen which engages a horizontal flange on the frame members, such as shown in U.S. Pat. Nos. 1,663,164 and 1,906,336. Other screen tensioning devices use a V-bar which clamps the screen portions adjacent its edges in a V-grooved channel, such as shown in U.S. Pat. Nos. 2,213,773, 2,378,463, and 3,776,382.

One of the most common types of screen tensioning means which is used, particularly in electrically heated screen assemblies, consists of angled blocks or flanges mounted on the frame members about which reinforced hook-shaped, stiffened screen edges are engaged. An example of this type of connection is shown in my heated screen assembly of U.S. Pat. No. 3,195,725.

Problems have been encountered in the past with many of these known tensioning rails, especially tensioning rails using a hook-shaped member which is engaged by complementary reinforced hook-shaped screen edges. It has been found that after extended periods of heated operation of the tensioned wire screen cloth that the heating of the screen results in some expansion and that the screen loosens from its hooked engagement with the flange of the tensioning rail. This results in poor tensioning contact which causes the screen to whip back and forth resulting in premature failure at the point of contact with the tensioning rail. This is a problem in both electrically heated and non-heated screen assemblies. This premature loosening of the screen rail engagement, however, is more critical in electrically heated screens in that it results in poor electrical contact between the screen and rails causing arcing, power loss and inefficient power use.

Prior tensioning rails are formed of relatively thin sheet metal which has a relatively short life when used in installations encountering abrasive materials such as slag, limestone, iron ore, silica sand, etc. These prior tensioning rail constructions are mounted on their side frame members by bolts, the heads of which project outwardly beyond the outer surface of the rails. These bolt heads also are subjected to the abrasive action of the materials being screened thereby.

It has been found that in many electrically heated screen assemblies metal strip edge stiffeners which are formed about and engaged with the edges of the screen, are required to provide the necessary stiffness to the screen. This reinforcing strip enables the screen to be drawn up tightly and tensioned by the rail and provides the necessary electrical contact between the rail and screen when initially installed. These stiffening strips usually are formed of stainless, plain or galvanized steel, thereby increasing both the material and installation costs of a screen assembly. However, screening with stiffening strip edges when heated are subject to the described expansion loosening.

No tensioning rail construction of which I am aware has eliminated these problems by providing a wedge-shaped clamping bar and complementary-shaped channel for firmly mounting the screen thereon.

SUMMARY OF THE INVENTION

Objectives of the invention include providing a tensioning rail construction for screen heaters having a wedge-shaped bar which clamps the hooked edge of a screen within a complementary wedge-shaped channel formed in the rear surface of the rail which provides a relatively large and continuous contact surface area between the tensioning rail and clamped screen edge to reduce premature loosening of the screen and to maintain a good electrical connection between the screen and rail; providing such a rail construction having a relatively large metal mass with a special cross-sectional shape to provide extreme rigidity so that large tensioning forces can be applied to the rail, establishing maximum efficiency for the electrical connection with the screen uniformly throughout the length of the tensioning rail, and to provide maximum screen life by reducing failure or wear at the clamped connection with the tensioning rail; providing such a rail construction in which one or both of the opposed clamping surfaces of the wedge bar and complementary channel is serrated to provide increased gripping contact between the wedge clamp and screen edge; providing such a rail construction in which the heads of the rail mounting bolts and of the wedge bar clamping bolts are recessed in the outer surface of the tensioning rail to increase the wear life thereof by reducing the abrasive action of the material being screened, and with which only two usual wrenches are required for installation, one for the wedge bar clamping bolts and the other for the nuts of the rail mounting bolts; providing such a rail construction in which a usual screen edge stiffening strip may be eliminated due to the broad clamping and electrical contact area between the wedge bar, screen edge and angled surface of the wedge-shaped channel, thereby reducing the labor and material cost of a screen installation; and providing an improved tensioning rail construction which eliminates difficulties existing in the art and which solves existing problems, satisfies needs and obtains new results in the art.

These objectives and advantages are obtained by the rail construction for mounting and tensioning a screen between a pair of spaced, longitudinally extending frame members, the general nature of which may be stated as including a metal rail member having outer, bottom and inner surfaces; the rail member inner surface having longitudinally extending wedge-shaped channel means formed therein, said channel means having an angled surface extending upwardly towards the outer surface to form with the rail member bottom surface a flange hook-shaped in cross section; bar means wedge-shaped in cross section having an angled surface generally complementary to the channel means angled surface; means movably mounting the bar means on the rail member in a position adjacent to and extending along the channel means operative to clamp a hook-shaped end formed along a longitudinal edge of a screen in the channel means between the complementary angled surfaces of the channel means and bar means when the hook-shaped screen end is engaged over the hook-shaped flange of the rail member; adjustable tensioning means extending between and engaging one of the frame members and the rail member operative to move the rail member toward the frame member to tension the screen; and insulation means between the rail and frame members for electrically insulating the rail member and screen from the frame member.

BRIEF DESCRIPTION OF THE DRAWINGS

A preferred embodiment of the invention—illustrative of the best mode in which applicant has contemplated applying the principle—is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 1:
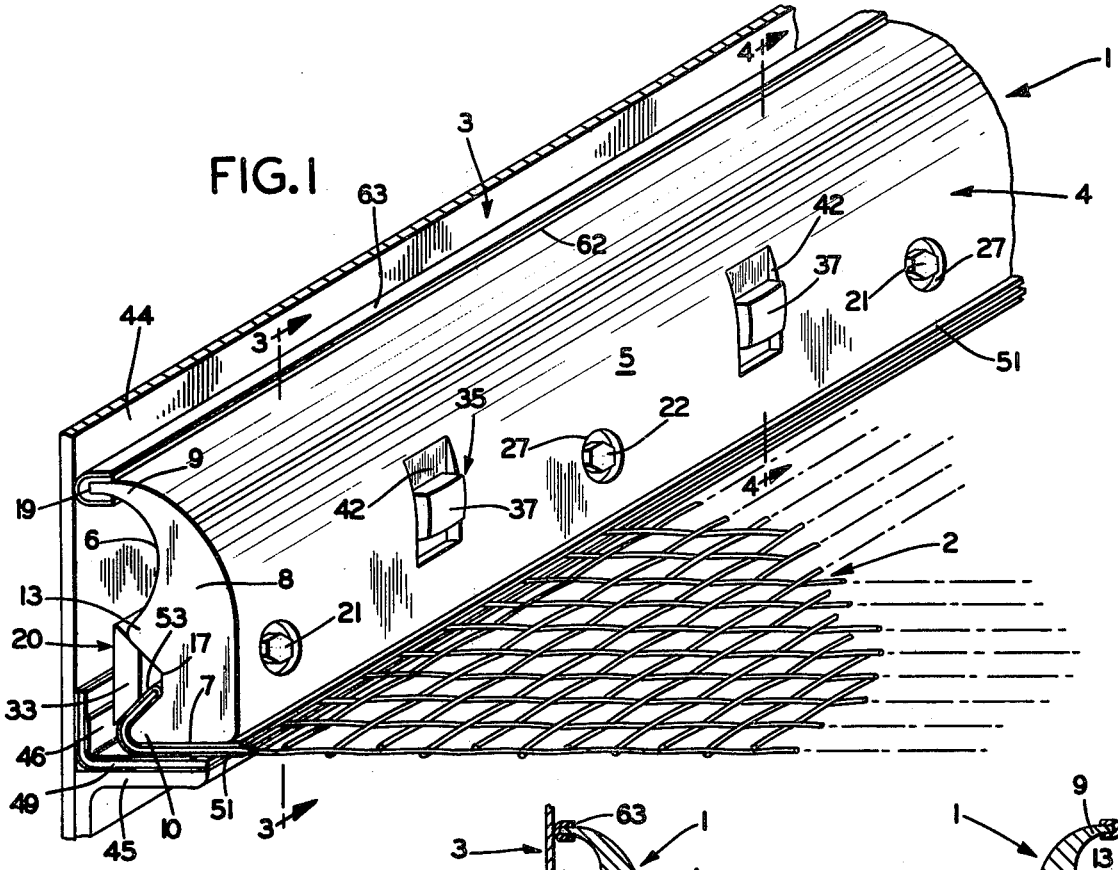
FIG. 1 is a fragmentary perspective view showing the improved tensioning rail construction mounted on a side frame member with a heated screen being clamped thereon.
Figure 8:
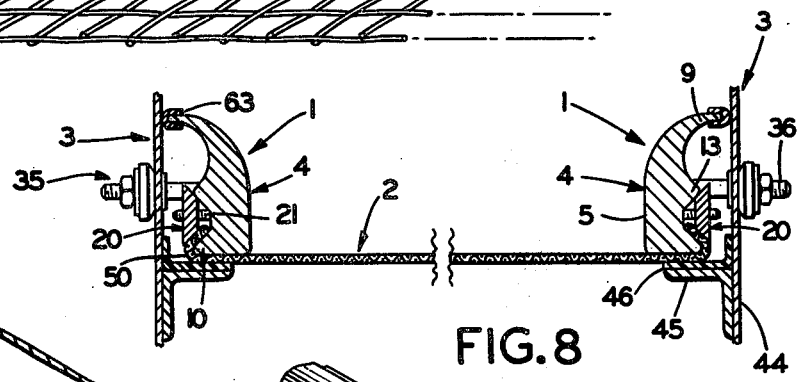
FIG. 8 is a fragmentary diagrammatic sectional view illustrating opposite improved rail constructions tensioning a screen panel.
Figure 2:
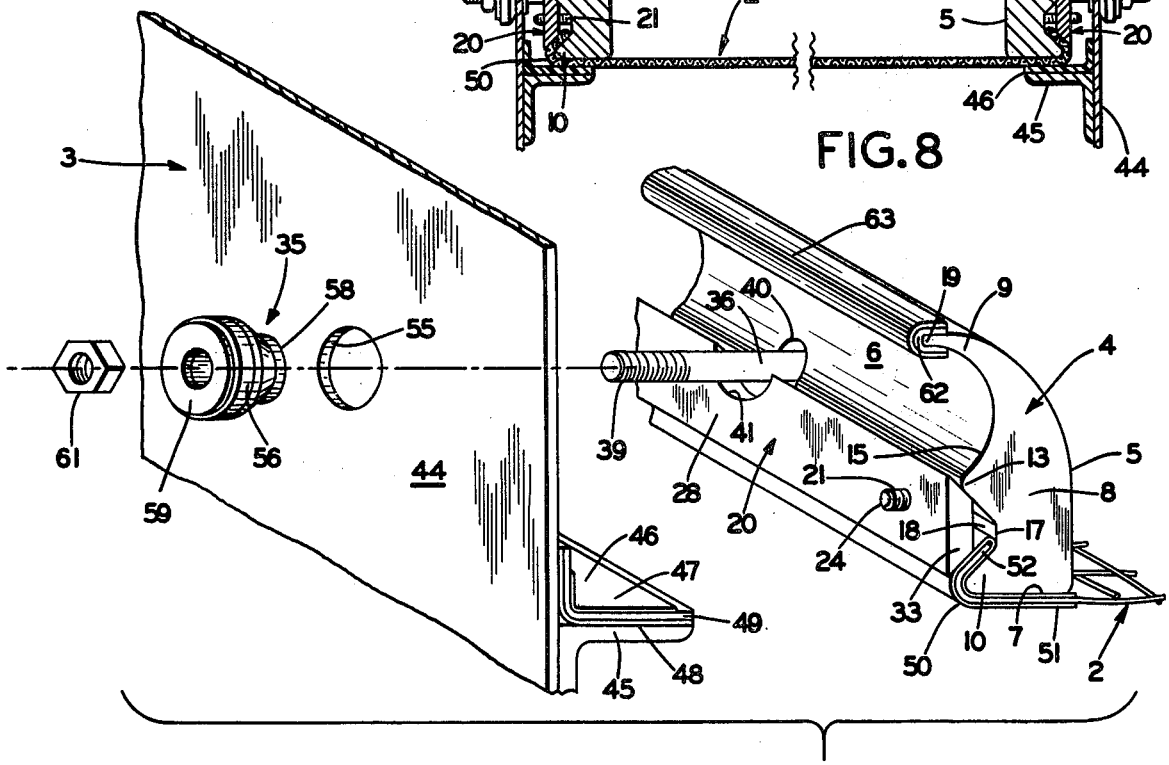
FIG. 2 is a fragmentary exploded perspective view of the tensioning rail and side frame member of FIG. 1.

A section of the improved tensioning rail construction is indicated generally at 1, and is shown in FIG. 1 tensioning and mounting a section of electrically heated screen 2 on a frame member 3. FIG. 8 illustrates a pair of the improved rail constructions 1 mounting and tensioning screen 2 between a pair of frame members 3 in a usual screen assembly. Tensioning rail 1 includes a rail member 4 formed of a relatively large metal mass when viewed in cross-section, preferably formed of an aluminum extrusion. Rail member 4 has a modified channel shape defined by an outer surface 5, inner surface 6, a horizontally extending planer bottom surface 7, and a vertical end surfaces 8 (FIGS. 1 and 2).

Outer surface 5 extends vertically upwardly from bottom surface 7 and terminates in an upper inwardly curved flange 9. A lower angled flange 10 is formed by bottom surface 7 and an inwardly upwardly extending angled surface 12 forming an included acute angle of approximately 45° therebetween. An intervening, generally V-shaped projection 13 is formed on inner surface 6 and is defined by an inwardly downwardly extending angled surface 14 and a concave, curved upper surface 15. Angled surfaces 12 and 14 are connected by a vertical surface 17 and together form a longitudinally extending wedge-shaped channel 18. Inner concave surface 15 joins with upper curved flange 9 in a rounded, horizontally extending edge 19.

Figure 3:
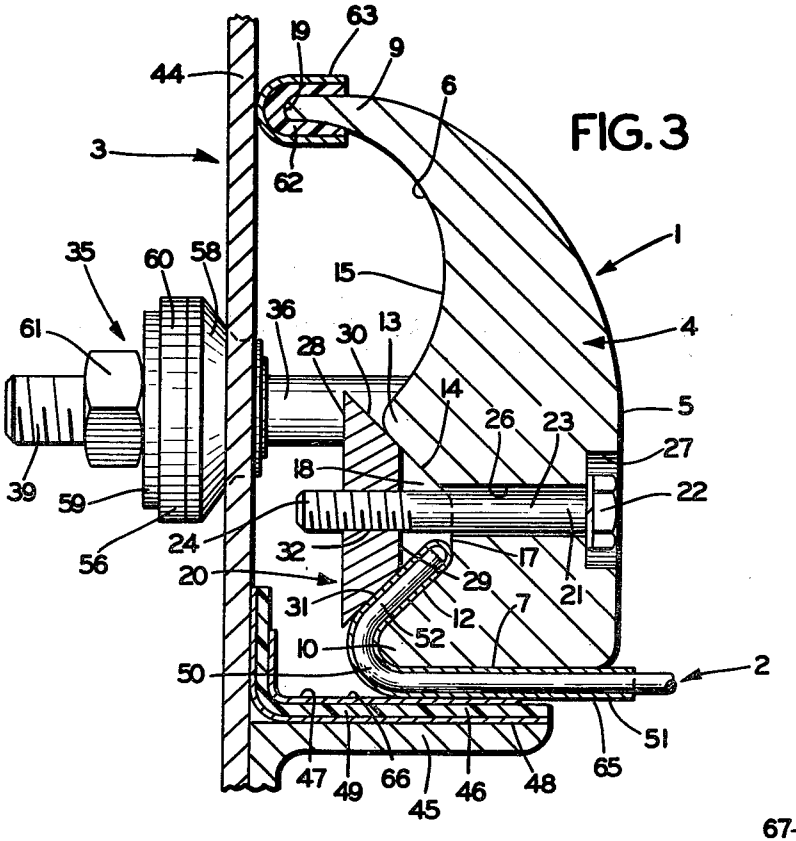
FIG. 3 is an enlarged fragmentary sectional view taken on line 3—3, FIG. 1.

In accordance with one of the main features of the invention, a wedge-shaped clamping bar, indicated generally at 20, is mounted on rail member 4 adjacent to channel 18 by a plurality of bolts 21 (FIGS. 1 and 3). Each bolt 21 includes a hexagonal-shaped head 22, a shank 23, and a threaded end 24. Bolts 21 extend through horizontally extending holes 26 formed in rail member 4. Circular recesses 27 are formed in outer surface 5 concentric with holes 26 for receiving bolt heads 22 therein. The inner ends of bolt holes 26 communicate with vertical wedge surface 17 of channel 18.

Clamping bar 20 has a trapezoidal-shaped cross-sectional configuration (FIGS. 2, 3 and 4) formed by vertically extending rear major surface 28, a parallel inner minor surface 29, angled side surfaces 30 and 31, and end surfaces 33. Horizontally extending threaded openings 32 are formed through clamping bar 20 for threadably receiving bolt ends 24. Angled surfaces 30 and 31 of clamping bar 20 are formed at an angle generally equal to the slopes of angled surfaces 12 and 14, respectively, of wedge-shaped channel 18.

Figure 4:
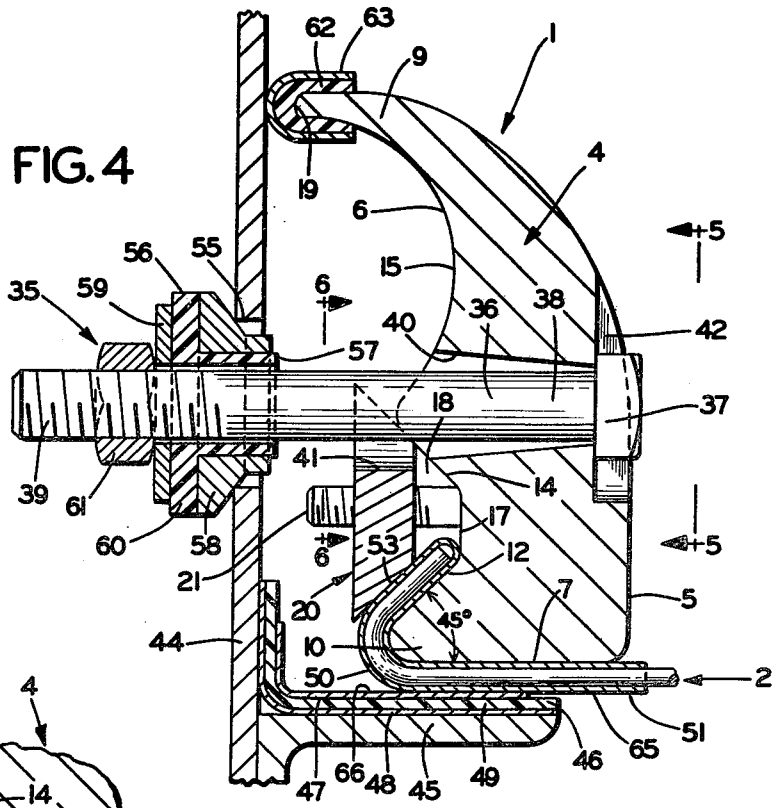
FIG. 4 is an enlarged fragmentary sectional view taken on line 4—4, FIG. 1.
Figure 6:
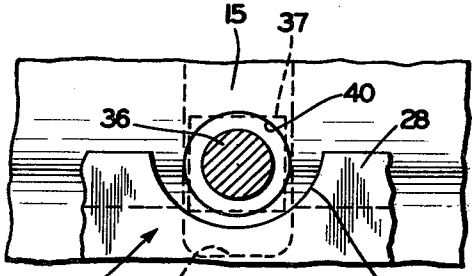
FIG. 6 is a fragmentary sectional view taken on line 6—6, FIG. 4.

Rail member 4 is movably mounted on a respective frame member 3 by a plurality of bolt assemblies 35 (FIGS. 2, 3 and 4). Bolt assemblies 35 each include a bolt 36 having a rectangular-shaped head 37 and a shank 38 which terminates in a threaded end 39. Bolts 36 extend through holes 40 which are formed in rail member 4 and which extend horizontally between outer surface 5 and V-shaped inner surface projection 13. Holes 40 have slightly tapered configurations as shown in FIG. 4 with the diameter of the holes adjacent projection 13 being larger than the opposite end of the hole. A concave notch 41 ((FIGS. 2 and 6) is formed in the upper portion of wedge bar 20 adjacent each hole 40 to provide passage of bolt 35 without contacting or interfering with bar 20.

Figure 5:
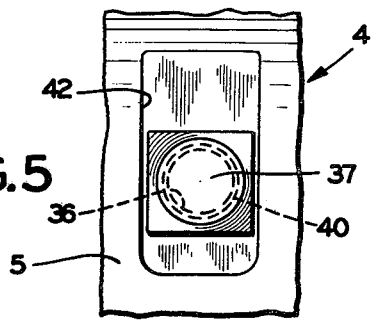
FIG. 5 is a fragmentary elevational view looking in the direction of arrows 5—5, FIG. 4.

A plurality of rectangular-shaped slots 42 are formed in outer surface 5 of rail member 4 (FIGS. 1, 4 and 5) concentric with holes 40. Slots 42 each have a width complementary to the width of rail mounting bolt heads 37. Bolt heads 37 are recessed in slots 42 which fix bolts 36 against rotation when projecting through rail member 4.

A usual screen assembly will include a pair of longitudinally extending side frame members 3 which are mounted in a spaced parallel relationship with screen 2 or a plurality of individual screen panels extending therebetween as shown in FIG. 8. Each frame member 3 includes a vertical wall 44 and a horizontal ledge 45. Wall 44 and ledge 45 preferably are formed of sheet metal possessing sufficient strength and rigidity for the particular application in which an electrically heated screen assembly is intended for use.

An L-shaped insulator plate 46 is mounted on frame ledge 45 and extends upwardly along a portion of frame wall 44 for electrically insulating screen 2 and rail 4 from frame member 3. Insulator plate 46 includes a pair of spaced L-shaped top and bottom metal plates 47 and 48, respectively, with an intervening thickness of an electrical insulating material 49. Top plate 47 preferably is smaller than bottom plate 48 as shown in FIGS. 3 and 4.

The longitudinal edges of screen 2 are formed with a reversely angled generally V-shape or hooked edge 50. Screen edge 50 may be reinforced by a usual complementary shaped hooked metal sheath 51. Hooked edge 50 of screen 2 and reinforcing metal sheath 51 have angled configurations which are complementary to lower angled flange 10 of rail member 4 and are in hooked engagement therewith (FIGS. 1, 2, 3 and 4) for mounting and tensioning screen 2 on rail member 4.

When installing screen 2 on rail member 4, hooked edge 50 and metal sheath 51 are mounted on angled flange 10 with angled legs 52 and 53 of screen edge 50 and sheath 51, respectively, being clamped between flat angled surface 12 of rail member 4 and angled end surface 31 of clamping bar 20. These mating angled surfaces provide a maximum gripping area and accordingly excellent electrical contact between screen 2 and rail member 4 throughout the entire length of clamped screen edge 50. Angled end surface 30 of clamping bar 20 will slidably contact angled surface 14 of wedge-shaped channel 18 when bar 20 is clamping screen edge 50 to provide even distribution of the forces on bar 20 to prevent twisting or pivotal movement of bar 20 on bolts 21. Clamping bar 20 is advanced into channel 18 easily by rotation of bolts 21 by a usual socket-type wrench engaging bolt heads 22. This same screen clamping procedure usually will be performed on the opposite edge of screen 2 by a similar rail member 4 and its clamping bar 20 (FIG. 8).

After hooked edge 50 of screen 2 is clamped to rail member 4 throughout its longitudinal length by a plurality of bolts 21 screen 2 then is tensioned between a pair of frame members 3 by outward movement of one or both rail members 4. Bolts 36 of rail mounting bolt assemblies 35 extend through holes 55 (FIGS. 2 and 4) which are formed in vertical frame wall 44 and which are horizontally aligned with rail holes 40, for drawing rail member 4 outwardly toward vertical frame wall 44. An electrical insulating bushing 56 (FIG. 4) is telescopically mounted on shank 38 of bolt 36 and includes a cylindrical sleeve portion 57 and an annular radial flange portion 60. Sleeve portion 57 is mounted concentrically within the bore of a conical metal washer 58. A flat disc-shaped metal washer 59 is mounted on bolt 36 and is in clamping engagement with radial flange portion 60 of insulating bushing 56 by nut 61. Bushing 56 electrically insulates bolt 36 from frame wall 44.

A third insulating zone is provided along upper flange edge 19 of rail 4 by enclosing edge 19 with a U-shaped strip of insulating material 62. Strip 62 in turn is covered by a complementary U-shaped metal strip 63 to physically protect insulating material 62 from being crushed by rail 4 as it is drawn tightly against frame wall 44.

Nuts 61 are rotated by a usual wrench which draws rail member 4 toward frame wall 44 and tensions screen 2 between spaced rail members 3 since screen 2 is securely clamped to rail member 4 by channel bar 20. Rail mounting holes 55 are larger than the diameter of bolt shank 38 and the outer circumference of conical washer 58 (FIG. 4) so as to permit movement of conical washer 58 with respect to the edges of holes 55. Enlarged holes 55 permit the continued movement of lower angled flange 10 toward frame wall 44 when tensioning screen 2, even when insulator protective strip 63 is engaged with vertical wall 44. The horizontal leg portion 65 of screen metal sheath 51 is slidably engaged with horizontal leg portion 66 of top L-shaped metal plate 47 of insulator plate assembly 46. Engagement of rectangular-shaped bolt heads 37 in complementary-shaped slots 42 prevent rotation of bolts 36 upon tightening of nuts 61. This requires only a pair of usual wrenches, one for clamping screen 2 on rail member 4 by bolts 21 and the other for clamping rail member 4 on frame member 3 by bolts 36.

Figure 7:
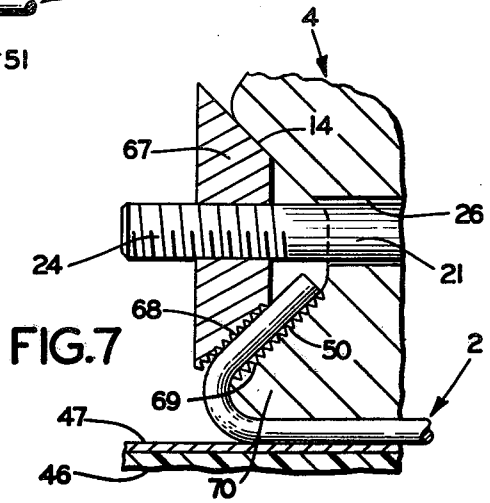
FIG. 7 is an enlarged fragmentary sectional view of a modified wedge-shaped clamping bar and channel configuration.

FIG. 7 shows a slightly modified construction of the wedge bar-screen clamping arrangement. Hooked edge 50 of screen 2 is clamped by a wedge-shaped clamping bar 67 without the use of reinforced hook-shaped metal sheath 51 as described above. Bar 67 is similar to bar 20 except angled end surface 68 is serrated. Preferably, angled clamping surface 69 of lower angled flange 70 also is serrated, and together with serrated surface 68 provide increased gripping contact between wedge clamp 67 and screen edge 50. This clamping arrangement eliminates reinforcing sheath 51, thereby decreasing the cost of a heated screen assembly without losing any of the advantages of the improved tensioning rail construction.

Mounting holes 26 for wedge bar clamping bolts 21 are positioned slightly above center of vertical surface 17 of wedge-shaped channel 18 (FIGS. 3 and 7). This positioning compensates for the anticipated thickness of hooked screen edge 50 and/or sheath 51 whereby angled top surface 30 of clamping bars 20 and 67 slidably engage corresponding angled surface 14 of channel 18 upon angled clamping surfaces 61 and 68 engaging the hooked end of screen 2 to prevent any twisting forces being exerted on clamping bars 20 and 67.

Improved tensioning rail construction 1 has a number of advantageous features. Heads 22 and 37 of the bar and rail clamping bolts 21 and 36 are recessed in the outer surface of rail member 4, requiring only two wrenches for installation of tensioning rail 1, and to reduce the abrasive action of the material being screened. The hooked edge 50 of screen 2, with or without reinforcing metal sheath 51, is clamped between a pair of flat surfaces 31 and 12, or between serrated surfaces 68 and 69 of wedge bars 20 or 67 and wedge channel 18 on tensioning rail 4 to provide a broad and continuous clamping surface. This broad surface provides a relatively large clamping area, and correspondingly, a relatively large electrical contact area between the edge of screen 2 and rail member 4 throughout the entire length of the clamped edge of screen 2.

Another advantage of the improved tensioning rail construction 1 is the ease of installing and replacing screen 2 or screen panel sections when worn or damaged. The wire screen cloth is usually in roll form and is cut to the necessary length and width for a particular screen or panel size of a heated screen installation. U-shaped metal sheath 51 is placed along the screen edge, if such a reinforcing sheath is desired, and then the hook-shaped screen edge 50 is formed by appropriate forming equipment along the entire longitudinal length of the screen edges. If reinforcing sheath 51 is not desired, the hook-shaped configuration is formed directly along the screen edges. It has been found that the wedge bar - edge channel configuration of improved rail construction 1 provides a uniform clamping of the hooked screen edges with an improved uniform electrical contact so that in many applications reinforcing sheath 51 can be eliminated with a subsequent cost reduction of both material and labor. The serrated surfaces 68 and 69 (FIG. 7) are especially desirable for direct clamping of the hooked edges of the screen when the metal reinforcing sheath has been eliminated.

Another advantage of improved construction 1 is that the large mass of rail member 4 with its special cross-sectional configuration provides extreme rigidity so that large tensioning forces can be applied to the rail establishing maximum efficiency for the electrical connections with screen 2 uniformly throughout the length of rail 4, and which provides for maximum screen life by reducing wear or failure of the screen at the clamped connection with the tensioning rail.

Also, the uniform clamping pressure and broad contact area between the wedge-shaped clamping bar, the screen edge and the clamping channel throughout the entire longitudinal length of the screen edge requires less power to heat the screen due to virtually no contact losses between the rail and screen, resulting in considerable energy savings and providing uniform screen heating.

Accordingly, the improved tensioning rail provides a construction which is effective, safe, less expensive in installation and operation than prior devices, efficient in assembly, operation and use, and which achieves all the enumerated objectives, provides for eliminating difficulties encountered with prior devices, and solves problems and obtains new results in the art.

Furthermore, the improved tensioning rail construction may be used in non-heated mechanical screen assemblies and need not be limited to electrically heated screen assemblies as described above. When used in mechanical screen assemblies, the insulation used in the three insulation zones shown in the drawings and described above can be eliminated.

Summarizing, the improved tensioning rail construction minimizes energy costs, increases productivity and reduces screen cloth replacement. The tensioning rail is a rugged aluminum extrusion that serves as a very efficient, high-capacity conductor, which provides more efficient heating at a lower cost, more uniform heating efficiency and higher production rates. The screen cloth lasts longer, reducing maintenance and downtime. The wedge-shaped clamping bar locks the screen cloth in a vice-like grip that will not loosen even under very severe operating conditions. By maintaining the more effective contact between the conductor and the cloth, the major causes of premature screen cloth failure, namely, contamination and arcing, which is the result of poor tensioning, are greatly reduced. The improved tensioning rails may be supplied in kit form for easy do-it-yourself retrofitting of all existing, electrically heated vibrating screens or may be a component for new electrically heated screens of various manufacturers.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the wedge-type tensioning rail construction for screen heaters is constructed and used, the characteristics of the construction, and the advantageous, new and useful results obtained; the new and useful structures, devices, elements, arrangements, parts, and combinations, are set forth in the appended claims.

I claim:

1. Rail construction for mounting and tensioning an electrically heated screen between a pair of spaced, longitudinally extending frame members including:

(a) a metal rail member having outer, bottom and inner surfaces;

(b) the rail member inner surface having longitudinally extending wedge-shaped channel means formed therein, said channel means having an angled surface extending acutely from the bottom surface upwardly towards the outer surface to form with the rail member bottom surface an acutely angled flange hook-shaped in cross section;

(c) bar means wedge-shaped in cross section having an angled surface generally complementary to the channel means acutely angled surface;

(d) bolt means movably mounting the bar means on the rail member, the bar means when so mounted being located in a position adjacent to and extending along the channel means to clamp a hook-shaped end formed along a longitudinal edge of a screen in the channel means between the acutely angled surface of the channel means and the complementary angled surface of the bar means when the hook-shaped screen end is engaged over the hook-shaped flange of the rail member;

(e) adjustable tensioning means extending between and engaging one of the frame members and the rail member operative to move the rail member toward the frame member to tension the screen; and (f) insulation means between the rail and frame members for electrically insulating the rail member and screen from the frame member.

2. The construction defined in claim 1 in which the rail member has a curved top flange formed between upper joining curved portions of the inner and outer rail member surfaces; in which the curved flange extends horizontally in the same direction as and spaced from the hook-shaped flange and terminates in a longitudinally extending edge; in which electrical insulation means encloses the curved flange edge; and in which the insulated curved flange is adapted to operatively engage the one frame member when the rail member tensions and mounts a screen on a pair of frame members.

3. The construction defined in claim 1 in which the included angle of the acutely angled hook-shaped flange is approximately 45° between the rail bottom surface and the channel means angled surface.

4. The construction defined in claim 1 in which the inner rail member surface is formed with projection means spaced above the hook-shaped flange; in which the projection means has an angled surface which extends downwardly toward the hook-shaped flange angled surface to form the wedge-shaped channel means.

5. The construction defined in claim 1 in which at least one of the complementary angled surfaces of the channel means and bar means is serrated to increase gripping contact with the hook-shaped screen end.

6. The construction defined in claim 1 in which a plurality of horizontally extending first holes are formed in the rail member and extend between and communicate with the outer surface of the rail member and the channel means; in which the bolt means for the bar means includes a plurality of bolts; and in which the bolts extend through the first holes and engage the bar means.

7. The construction defined in claim 6 in which recesses are formed in the outer surface of the rail member concentric with the first bolt holes; and in which the bolts include heads which are located within the recesses.

8. The construction defined in claim 1 in which a plurality of horizontally extending second holes are formed in the rail member; in which the rail member tensioning means includes bolts which extend through said second holes; and in which said bolts are adapted to extend through aligned holes formed in the frame member to adjustably mount the rail member on said frame member.

9. The construction defined in claim 8 in which electrical insulating means is mounted on each of the rail member mounting bolts to electrically insulate said bolts from the frame member.

10. Rail construction for mounting and tensioning a screen between a pair of spaced, longitudinally extending frame members including:

(a) a rigid rail member having outer, bottom and inner surfaces;

(b) the rail member inner surface having longitudinally extending wedge-shaped channel means formed therein, said channel means having an angled surface extending acutely from the bottom surface upwardly towards the outer surface to form with the rail member bottom surface an acutely angled flange hook-shaped in cross section;

(c) bar means wedge-shaped in cross section having an angled surface generally complementary to the channel means acutely angled surface;

(d) bolt means movably mounting the bar means on the rail member, the bar means when so mounted being located in a position adjacent to and extending along the channel means to clamp a hook-shaped end formed along a longitudinal edge of a screen in the channel means between the acutely angled surface of the channel means and the complementary angled surface of the bar means when the hook-shaped screen end is engaged over the hook-shaped flange of the rail member; and (e) adjustable tensioning means extending between and engaging one of the frame members and the rail member operative to move the rail member toward the frame member to tension the screen.

11. The construction defined in claim 10 in which the rail member has a curved top flange which is adapted to operatively engage a frame member; in which the rail member inner surface is formed with generally V-shaped projection means intermediate the curved top flange and hook-shaped flange; in which the projection means has an angled surface which extends downwardly toward the hook-shaped flange angled surface to form the wedge-shaped channel means; and in which the projection means has a smooth concavely curved surface which joins with an upper curved portion of the rail member outer surface to form said curved top flange.

12. The construction defined in claim 10 in which the bolt means includes a plurality of bolts; in which a plurality of horizontally extending first holes are formed in the rail member; and in which the mounting bolts extend through said rail member first holes and operatively engage the bar means.

13. The construction defined in claim 10 in which the rail member tensioning means includes a plurality of bolts; in which a plurality of horizontally extending second holes are formed in the rail member; and in which the tensioning bolts extend through said rail member second holes and operatively engage a frame member.

14. In an electrical heated screen construction of the type having a pair of horizontally longitudinally extending spaced frame members, and having a screen extending between the frame members and mounted and tensioned thereon by a pair of tensioning rail means mounted on the frame members, said rail means each including:

(a) a metal rail member having a cross-sectional configuration defined by an upwardly inwardly curved outer surface terminating in a generally horizontal top flange, a horizontal planar bottom surface, and an inner surface having an intermediate projection which forms a portion of the top flange and a wedge-shaped channel which forms a hook-shaped flange with the bottom surface;

(b) wedge-shaped clamping bar means having a cross-sectional configuration generally complementary to the wedge-shaped channel;

(c) first bolt means extending horizontally through the rail member and engageable with the clamping bar means for moving said clamping bar means toward the channel means for clampingly engaging a hook-shaped end of a screen which is adapted to be mounted on the hook-shaped flange of the rail member;

(d) second bolt means extending horizontally through the rail member for engagement with a frame member for moving said rail member toward the frame member to tension the screen being clamped on the rail member by the bar means; and (e) electrical insulation means mounted on the horizontal top flange and on the second bolt means to electrically insulate the rail member from the frame member.

15. The construction defined in claim 14 in which each rail member is formed of an aluminum extrusion.

16. The construction defined in claim 14 in which recesses are formed in the outer surfaces of each rail member; and in which the first and second bolt means have heads which are located within said recesses.

17. The construction defined in claim 14 in which the hook-shaped flange on each rail member has an included acute angle of approximately 45°.

* * * * *